US005553988A

United States Patent [19]

Horn et al.

[11] Patent Number: 5,553,988

[45] Date of Patent: Sep. 10, 1996

[54] METHOD OF AND APPARATUS FOR MANIPULATING CONTAINERS FOR CIGARETTE TRAYS

[75] Inventors: Matthias Horn, Ahrensburg; Peter Kägeler, Geesthacht, both of Germany

[73] Assignee: Hauni Maschinenbau AG, Hamburg, Germany

[21] Appl. No.: 383,084

[22] Filed: Feb. 2, 1995

[30] Foreign Application Priority Data

Feb. 16, 1994 [DE] Germany ..... 44 04 902.1

[51] Int. Cl.[6] ..... A24C 5/352

[52] U.S. Cl. ..... 414/416; 198/463.3; 198/465.1; 414/609; 414/786

[58] Field of Search ..... 414/403, 416, 414/607, 786; 198/465.1, 463.3

[56] References Cited

U.S. PATENT DOCUMENTS

| | | | |
|---|---|---|---|
| 2,596,339 | 5/1952 | Lufkin | 414/403 X |
| 4,449,625 | 5/1984 | Grieben et al. | 198/465.1 |
| 4,564,329 | 1/1986 | Bantien | 414/403 |
| 4,747,743 | 5/1988 | Dowding et al. | 414/403 |
| 4,867,299 | 9/1989 | Fukuoka et al. | 198/463.3 X |
| 4,946,340 | 8/1990 | Murphy et al. | 414/416 X |
| 4,995,769 | 2/1991 | Berger et al. | 414/403 |
| 5,106,254 | 4/1992 | Tolasch et al. | 414/403 X |
| 5,123,798 | 6/1992 | Glösmann et al. | 414/403 |
| 5,190,434 | 3/1993 | Miura et al. | 414/416 X |

FOREIGN PATENT DOCUMENTS

| | | | |
|---|---|---|---|
| 1547809 | 6/1979 | United Kingdom | 414/403 |

*Primary Examiner*—David A. Bucci
*Attorney, Agent, or Firm*—Darby & Darby, P.C.

[57] ABSTRACT

Containers for temporary confinement of empty and filled trays serving for temporary storage of rod-shaped articles of the tobacco processing industry are advanced, one after the other, first at an upper level to a first station for evacuation of empty trays, thereupon downwardly to, along and beyond a second station for introduction of filled trays at a lower level, and then to the upper level for withdrawal from the apparatus. Empty trays are filled with rod-shaped articles during downward movement from the first station to the second station. One or more pneumatically operated devices can be employed to expel or otherwise remove empty trays from the container at the first station, and one or more similar devices can be used for reintroduction of filled trays into the container at the second station. The unit for lowering empty containers from the first station to the second station can utilize plural grippers having rotary supports which bear against the containers from below during advancement past the first station and during downward movement to the second station.

18 Claims, 5 Drawing Sheets

METHOD OF AND APPARATUS FOR MANIPULATING CONTAINERS FOR CIGARETTE TRAYS

BACKGROUND OF THE INVENTION

The invention relates to improvements in apparatus for manipulating receptacles (known as and hereinafter called trays) for temporary storage of plain or filter cigarettes, cigars, cigarillos or filter rod sections, i.e., rod-shaped articles of the tobacco processing industry. More particularly, the invention relates to improvements in methods of and apparatus for manipulating containers for temporary confinement of filled and empty trays in cigarette making plants and similar establishments.

Trays for storage of rod-shaped articles of the tobacco processing industry (hereinafter called cigarettes or filter cigarettes for short) are utilized to take up the surplus of freshly produced cigarettes when the output of one or more cigarette makers exceeds the requirements of the processing machine or machines which receive cigarettes from such maker or makers. Filled trays are maintained in a position of readiness for evacuation of their contents when the requirements of one or more processing machines (e.g., cigarette packing machines) exceed the momentary output of the corresponding cigarette maker or makers.

As a rule, a supply of empty trays is maintained at an upper level of a tray filling machine, and the empty trays are caused to descend toward and ultimately to a lower level in the course of the tray filling operation. On the other hand, a supply of filled trays is maintained at an upper level in a tray evacuating or emptying machine, and the filled trays are caused to descend toward and ultimately reach a lower level during removal of their contents, e.g., for introduction into a filter tipping machine or into a cigarette or filter cigarette packing machine.

It has been found that the transport of empty and filled trays to and from tray filling machines as well as the transport of filled and empty trays to and from tray evacuating or emptying machines can be simplified if sets or arrays or groups of empty or filled trays are transported while being confined in so-called containers. Presently utilized containers constitute substantially box-shaped bodies which are designed to afford convenient introduction of filled or empty trays as well as to permit convenient withdrawal or expulsion of empty or filled trays.

A drawback of heretofore known apparatus for manipulation of containers for empty and filled trays is that they occupy a substantial amount of floor space as well as that the controls for movements of containers along their paths are rather complex.

OBJECTS OF THE INVENTION

An object of the invention is to provide a simple, compact and reliable apparatus for the manipulation of containers for temporary confinement of empty or filled cigarette trays.

Another object of the invention is to provide a novel and improved distribution of paths for the advancement of empty and filled trays toward as well as at and beyond tray evacuating and tray inserting or introducing stations.

A further object of the invention is to provide an apparatus which reliably maintains one or more filled containers at or close to the tray evacuating station and at least one empty container at the tray inserting or introducing station.

An additional object of the invention is to provide the above outlined apparatus with novel and improved means for moving empty and filled containers between different levels.

Still another object of the invention is to provide the above outlined apparatus with novel and improved means for introducing trays into empty or partially empty containers as well as for extracting or expelling trays from filled or partially filled containers.

A further object of the invention is to provide a novel and improved method of manipulating containers for empty and filled trays or analogous receptacles for rod-shaped articles of the tobacco processing industry.

Another object of the invention is to provide a novel and improved method of regulating the advancement of rod-shaped articles of the tobacco processing industry between one or more makers and one or more processing machines.

An additional object of the invention is to provide an apparatus which can be utilized for the practice of the above outlined method and is constructed and assembled in such a way that it can temporarily store large or small quantities of rod-shaped articles of the tobacco processing industry.

SUMMARY OF THE INVENTION

The method of the present invention can be resorted to for the manipulation of successive empty and filled containers for temporary confinement of trays which, in turn, are utilized for temporary storage of cigarettes or other rod-shaped articles of the tobacco processing industry and are being advanced between an upper level and a lower level subsequent to termination of and prior to confinement in the containers. The method comprises the steps of transporting successive filled containers at the upper level, removing trays from successive containers at the upper level and moving the thus withdrawn trays downwardly to the lower level, lowering successive emptied containers from the upper level to the lower level, and introducing trays into successive emptied containers at the lower level.

The transporting step can include moving successive filled containers in stepwise fashion to a predetermined position at the upper level, and the removing step can include evacuating discrete trays between successive stepwise movements of the respective containers at the upper level. The lowering step of such method can include effecting a downward movement of successive emptied containers from the preselected positions at the upper level to the lower level.

The method can further comprise the step of transporting emptied containers at the lower level upon completion of the respective lowering steps, and the introducing step of such method can include inserting discrete trays into successive emptied containers between successive stepwise transports of emptied containers at the lower level.

In accordance with one presently preferred embodiment of the improved method, the removing step includes evacuating discrete trays seriatim from the respective containers at a first predetermined location at the upper level, and the introducing step of such method can include introducing discrete trays seriatim into the respective emptied containers at a second predetermined location which is disposed at the lower level and is in at least substantial vertical alignment with the first predetermined location.

The transporting step of the improved method can include moving successive filled containers to a first predetermined position at the upper level, and the lowering step of such method can include effecting a downward movement of successive emptied containers from the first predetermined position at the upper level to a second predetermined position disposed at the lower level and being in at least substantial vertical alignment with the first predetermined position.

At least one of the removing and introducing steps can include pneumatically moving the trays relative to the respective containers. Such method can be practiced with advantage for the manipulation of containers for sets of trays of the type having first and second relatively narrow and substantially upright sidewalls. The removing step can include attracting the first sidewalls of the trays by suction, and the introducing step can include attracting the second sidewalls of the trays by suction.

The transporting step can include moving successive filled containers at the upper level in a first direction and thereupon in a second direction other than (e.g., at right angles to) the first direction.

The method can further comprise the steps of conveying successive refilled containers at the lower level and thereupon lifting the refilled containers from the lower level to the upper level.

The improved apparatus can be utilized as a means for manipulating successive empty and filled containers for temporary confinement of sets of trays which, in turn, are utilized for temporary storage of plain or filter cigarettes or other rod-shaped articles of the tobacco processing industry. The apparatus comprises means for transporting filled containers at a first level to an emptying station, means for conveying filled containers at a lower second level from a filling station, and means for lowering successive empty containers from the emptying station to the filling station.

The transporting means can include means for moving successive filled containers in stepwise fashion at the emptying station and onto the lowering means. The conveying means can comprise means for moving successive emptied containers in stepwise fashion at the filling station. The arrangement can be such that the transporting means includes means for moving successive filled containers at the emptying station and onto the lowering means in a first direction, and that the conveying means includes means for moving successive emptied containers in stepwise fashion at the filling station in a second direction at least substantially counter to the first direction.

The lowering means can comprise a plurality of grippers including rotary supports and means for moving at least one of the grippers relative to each other gripper to thereby move the supports beneath a container at the emptying station and to move the supports away from the lowered container at the filling station. The rotary supports can include rows of rollers. The conveying means of such apparatus can include means for moving containers along and away from the filling station in a predetermined direction, and additional rotary supports for successive lowered containers at the filling station; the additional supports are or can be staggered in the predetermined direction with reference to the supports of the grippers.

The apparatus further comprises means for removing sets of trays from successive containers at the emptying station, and means for introducing sets of trays into successive emptied containers at the filling station. At least one of the tray removing and tray introducing means can include fluid-operated (preferably pneumatic) means for moving trays at the respective station. For example, the pneumatic means can comprise means for attracting trays by suction.

Still further, the apparatus can comprise means for lifting containers from the lower level to the first level. The lifting means can include at least one platform which is arranged to receive successive filled containers from the conveying means and to move the thus received containers from the lower level to the first level.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
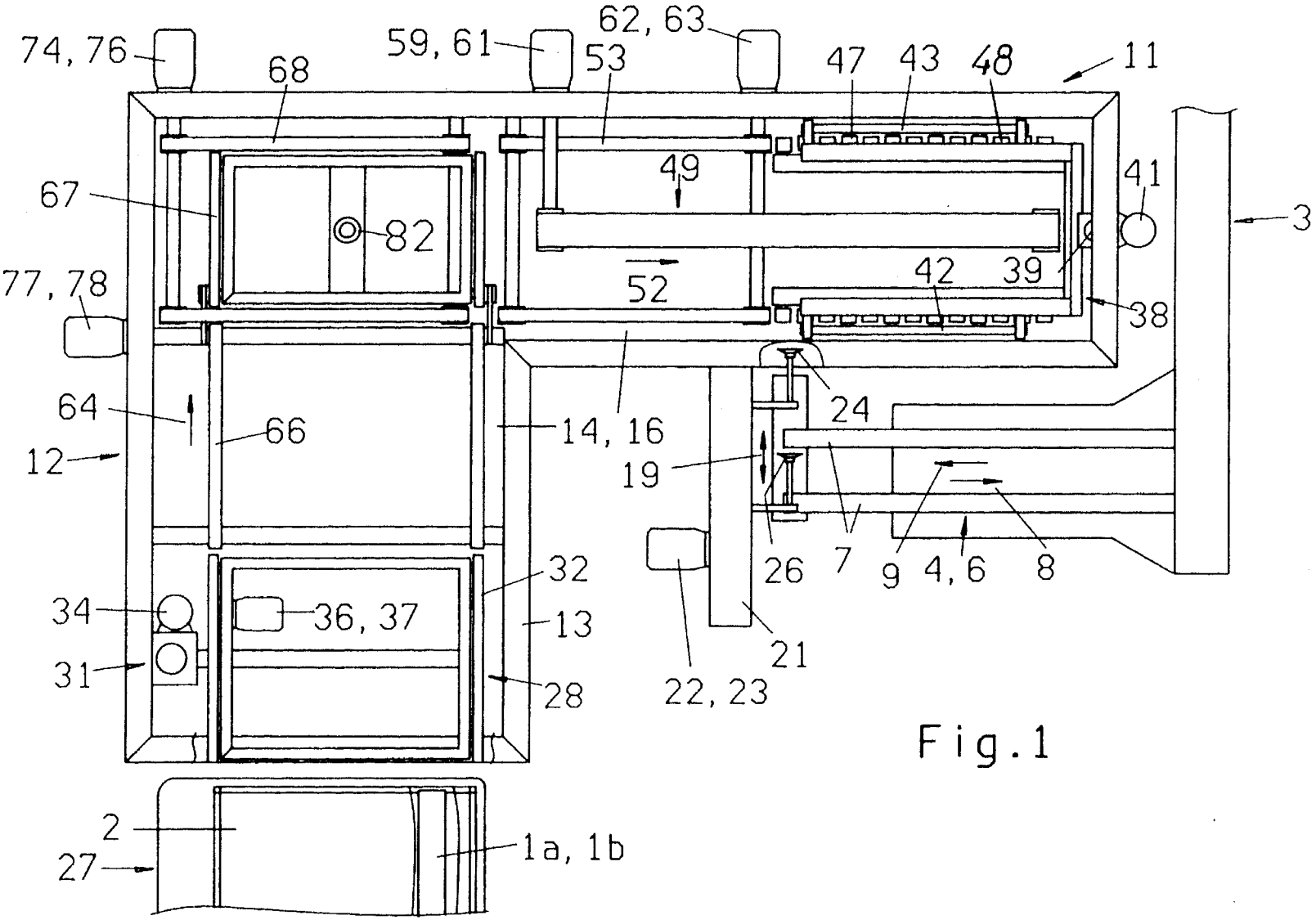
FIG. 1 is a plan view of a container manipulating apparatus which embodies one form of the invention.

The apparatus which is shown in FIGS. 1 to 7 serves for manipulation of substantially box-shaped containers 2 (shown in FIGS. 1 and 3 to 7) each of which can confine a set of (for example, nine) upright trays 1. The empty trays are shown at 1*a* and the filled trays are shown at 1*b*. Each filled tray contains a pile of parallel rod-shaped articles of the tobacco processing industry, e.g., filter cigarettes which are turned out by a filter tipping machine and are to be transported to one or more processing machines, e.g., packing machines or reservoirs for temporary storage of those articles (hereinafter called cigarettes) which cannot be immediately accepted by a packing machine. Thus, the apparatus stores cigarettes when the output of one or more makers exceeds the requirements of the corresponding processing machine or machines, and the apparatus can dispense cigarettes when the requirements of one or more processing machines exceed the output of the corresponding maker or makers. The drawings merely show those portions of the apparatus which serve to deliver containers 2 with empty trays 1*a* to a first or upper station 4 (FIGS. 1 and 7) where the empty trays la are withdrawn, expelled or otherwise removed from the respective container, which serve to lower the thus emptied containers from the (upper) level 14 of the first station 4 to the (lower) level 16 of a second or lower station 6, which serve to move successive emptied containers 2 past the station 6 for reception of sets of freshly filled trays 1*b* and thereupon beyond the second station, and which serve to thereupon lift successive filled containers 2 to the upper level 14 for advancement to a tray evacuating or emptying station.

Figure 7:
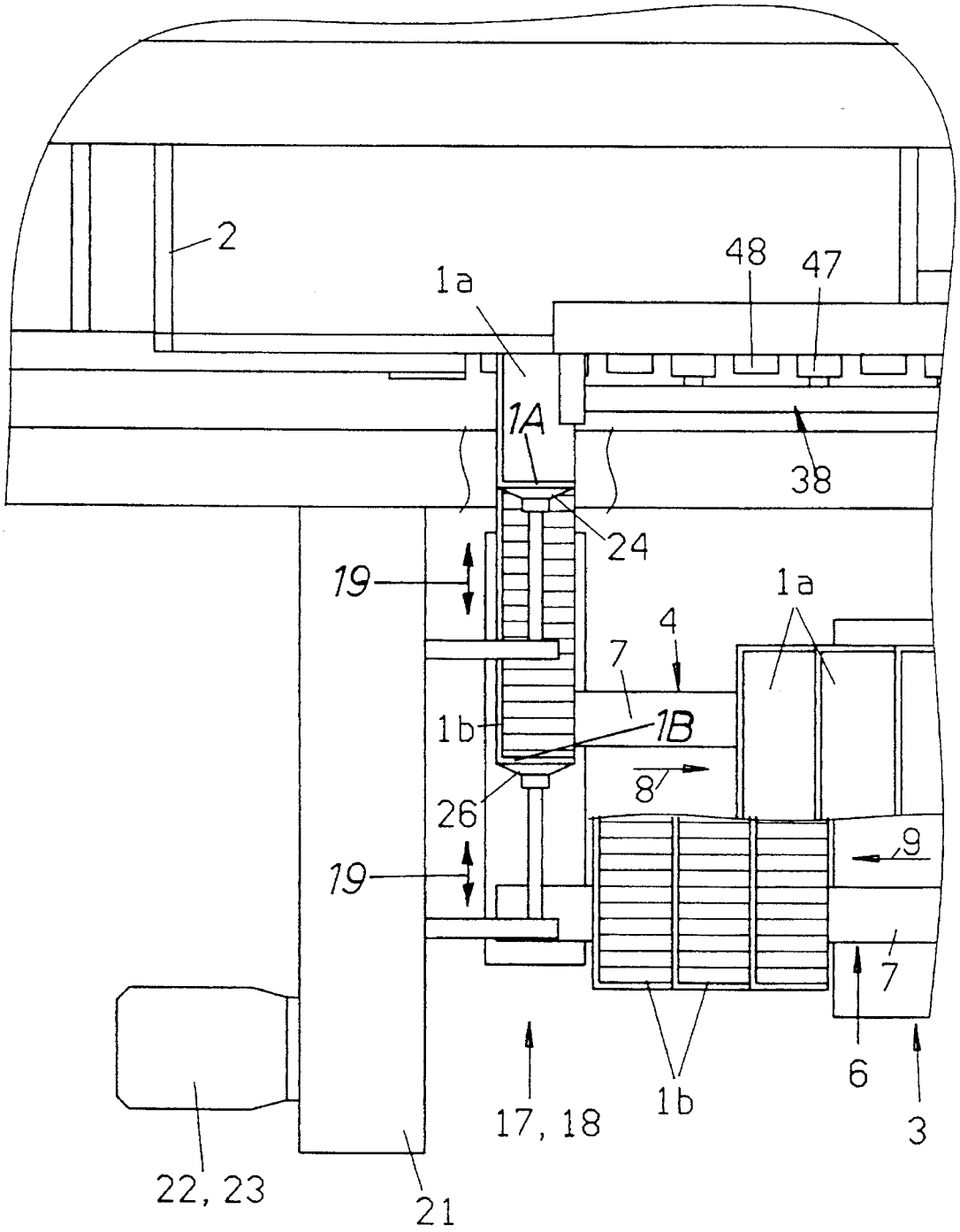
FIG. 7 is an enlarged plan view of a detail in the structure of FIG. 1.

The character 3 denotes in FIGS. 1 and 7 a tray filling apparatus which introduces cigarettes into successive empty trays 1*a* while such trays descend from the station 4 at the upper level 14 to the station 6 at the lower level 16. The apparatus 3 can be of the type known as HCF 80 distributed by the assignee of the present application. Such apparatus is designed to accept the surplus when the output of one or more cigarette makers exceeds the requirements of the associated processing machine or machines. The improved container manipulating apparatus can be utilized to operatively connect the tray filling apparatus 3 (such as the aforementioned HCF 80) with a tray evacuating apparatus, e.g., an apparatus known as MAGOMAT 80 which is also distributed by the assignee of the present application. The tray evacuating apparatus is set in operation when the output of one or more cigarette makers cannot satisfy the requirements of the associated processing machine or machines. An available unit which utilizes one or more tray filling apparatus and one or more tray emptying apparatus as well as apparatus for circulating empty and filled trays between the tray filling and tray emptying apparatus is known as COMFLEX 1 which is also distributed by the assigneee of the present application.

One presently known apparatus for transporting holders for cigarette trays between an upper level and a lower level is disclosed in commonly owned U.S. Pat. No. 4,449,625 granted May 22, 1984 to Grieben et al. for "Apparatus for transporting trays for cigarettes or the like". Another presently known apparatus for the manipulation of empty and filled cigarette trays is disclosed in commonly owned U.S. Pat. No. 4,564,329 granted Jan. 14, 1986 to Bantien for "Apparatus for manipulating empty and filled trays for cigarettes or the like between making and processing machines". An apparatus for filling and emptying cigarette trays is disclosed in commonly owned U.S. Pat. No. 5,106,254 granted Apr. 21, 1992 to Tolasch et al. for "Apparatus for filling and emptying trays for rod-shaped articles of the tobacco processing industry". The disclosures of the above enumerated patents are incorporated herein by reference.

The containers which are being manipulated in accordance with the improved method and in the apparatus of the present invention are or can be of the type disclosed in commonly owned copending U.S. patent application Ser. No. 08/382,919 filed Feb. 3, 1995 by Matthias Horn, Peter Kägeler and Christian Kreusch for "Mobile receptacles for cigarette trays".

Endless belt conveyors 7 or other suitable conveyors at the stations 4 and 6 are utilized for the transport of empty and at least partly filled trays 1 at the upper level 14 and the lower level 16. The direction of advancement of initially empty trays 1*a* at the tray filling unit 3 (for reception of piles of cigarettes at the station 4) is indicated (in FIGS. 1 and 7) by the arrows 8, and the direction of advancement of filled trays 1*b* at the station 6 is indicated by the arrows 9. The unit 3 further comprises means (not specifically shown) for lowering freshly filled trays 1*b* from the upper level 14 to the lower level 16, i.e., from the station 4 to the station 6. The station 6 is or can be located beneath and can be in vertical alignment with the station 4.

The character 27 denotes in FIG. 1 a conveyor system which is designed to move successive filled containers 2 with filled trays 1*b* from the improved apparatus to a tray evacuating apparatus (not shown) and to move containers carrying sets of empty trays 1*a* from the evacuating apparatus back to the improved container manipulating apparatus. Containers 2 which confine filled trays 1*b* are advanced (at the lower level 16) from the station 6 to a lifting conveyor 12 which moves successive filled containers to the upper level 14 and into the range of the conveyor system 27. As already mentioned above, the conveyor system 27 is designed to move containers 2 with filled trays 1*b* from the lifting conveyor 12 to the tray emptying apparatus and to advance containers 2 with empty trays 1*a* from the tray emptying apparatus to the upper level 14 of the improved apparatus. The tray emptying apparatus can be a substantial mirror image of the tray filling apparatus 3, i.e., such emptying apparatus can receive filled trays 1*b* at an upper level and can discharge emptied trays 1*a* at a lower level.

The improved container manipulating apparatus occupies a substantially L-shaped space or station 11 and includes a frame 13 for the lifting conveyor 12, for transporting means including conveyors for moving containers 2 with sets of empty trays 1*a* at the upper level 14 from the conveyor system 27 to the station 4, a conveyor 38 which serves as a means for lowering successive emptied containers 2 from the upper level 14 (station 4) to the lower level 16 (station 6), and means for conveying empty, partially filled and filled containers 2 past the station 6 and (still at the lower level 16) to the lifting conveyor 12. That (elongated) portion of the frame 13 which accommodates the stations 4 and 6, the conveyors which transport containers 2 with empty trays 1*a* to the station 4, and the conveyors for moving containers 2 with filled trays 1*b* from the station 6 toward the lifting conveyor 12 extends at right angles to the frame portion for the lifting conveyor 12.

That portion of the upper level 14 within the frame 13 which is occupied by a container 2 adjacent the tray expelling or removing station 4 is shown at 17 (FIG. 7), and that portion of the lower level 16 which is occupied by a container 2 at the station 6 is shown at 18 (again in FIG. 7). The means for removing empty trays 1*a* from a container 2 at the station 4 includes one or more pneumatic devices 24, e.g., suction cups which can contact and exert a pull upon the outer sides of relatively narrow upright sidewalls 1A of successive trays in a container 2 at the station 4. The means for introducing filled trays 1*b* into a container at the station 6 also includes one or more pneumatic devices 26, e.g., one or more suction cups which can engage and move (push) successive filled trays 1*b* of a set of such trays from the tray filling apparatus 3 into the adjacent container. The means for moving the, suction cup(s) 24 at the upper level 14 in directions indicated by the upper double-headed arrow 19 in FIG. 7 includes a reversible electric motor 22 or another suitable prime mover. A second reversible electric motor 23 or an analogous prime mover is provided to move the suction cup(s) 26 at the lower level 16 in directions indicated by the lower double-headed arrow 19 of FIG. 7. The suction cup(s) 26 can adhere to second relatively narrow upright sidewalls 1B of filled trays 1*b* which are to be transferred from the station 6 (i.e., from the tray filling apparatus 3) into the adjacent container 2. The means for confining the suction cups 24, 26 to reciprocatory movements in directions indicated by the double-headed arrows 19 includes one or more guides 21.

The lifting conveyor 12 comprises an upright carrier 31 for two vertically spaced-apart horizontal platforms 28 and 29. The lower platform 29 is located at the level 16 when the upper platform 28 is located at the level 14, and the platform 28 is lifted above the level 14 in response to lifting of the lower platform 29 (with a container confining filled trays 1*b*)

from the level 16 to the level 14. The platform 29 includes or carries endless belt conveyors 33 which can advance a container 2 in the direction indicated by arrows 71, and the platform 28 includes or carries belt conveyors 32 which can advance a container 2 in the direction indicated by the arrows 64. When the conveyors 33 are driven, they can move a container 2 with filled trays 1*b* therein from the upper level 14 onto the conveyor system 27 for introduction into the aforementioned tray evacuating apparatus. When the conveyors. 32 are driven, they can advance a container 2 with empty trays la therein from the lifting conveyor 12 onto the adjacent endless belts 66 forming (an optional) part of the means for transporting successive containers 2 with sets of empty trays 1*a* therein from the conveyor system 12 to the station 4.

A reversible electric motor 34 or another suitable reversible prime mover is used to move the platforms 28, 29 up and down along the upright carrier 31 of the lifting conveyor 12. Another electric motor 36 is used to drive (when necessary) the belt conveyors 32 on or of the platform 29 in the direction of arrows 64, and a further electric motor 37 serves to drive the belt conveyors 33 on or of the platform 29 in the direction indicated by the arrow 71.

Figure 4:
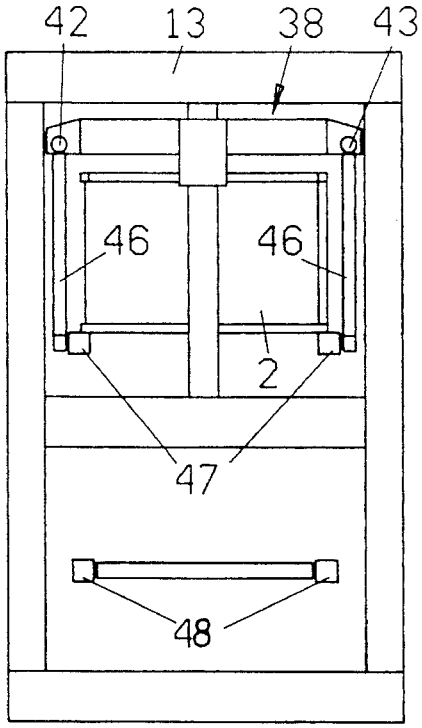
FIG. 4 is an elevational view of the means for lowering containers from the upper level to the lower level, with a container shown at the upper level.
Figure 5:
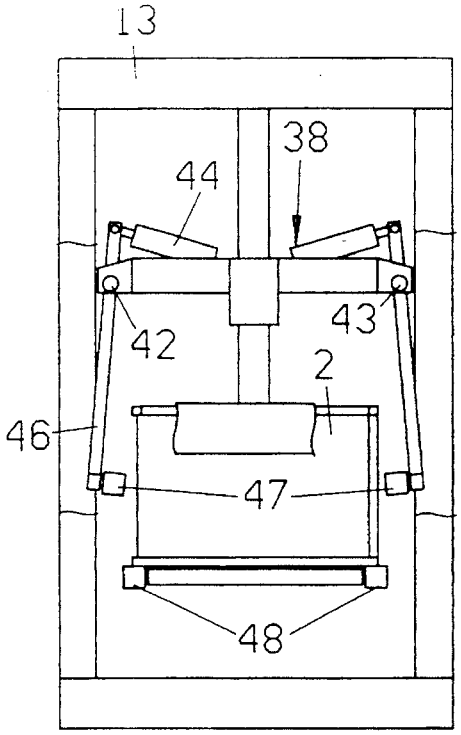
FIG. 5 illustrates the structure of FIG. 4 upon completed lowering of a container to the lower level.
Figure 6:
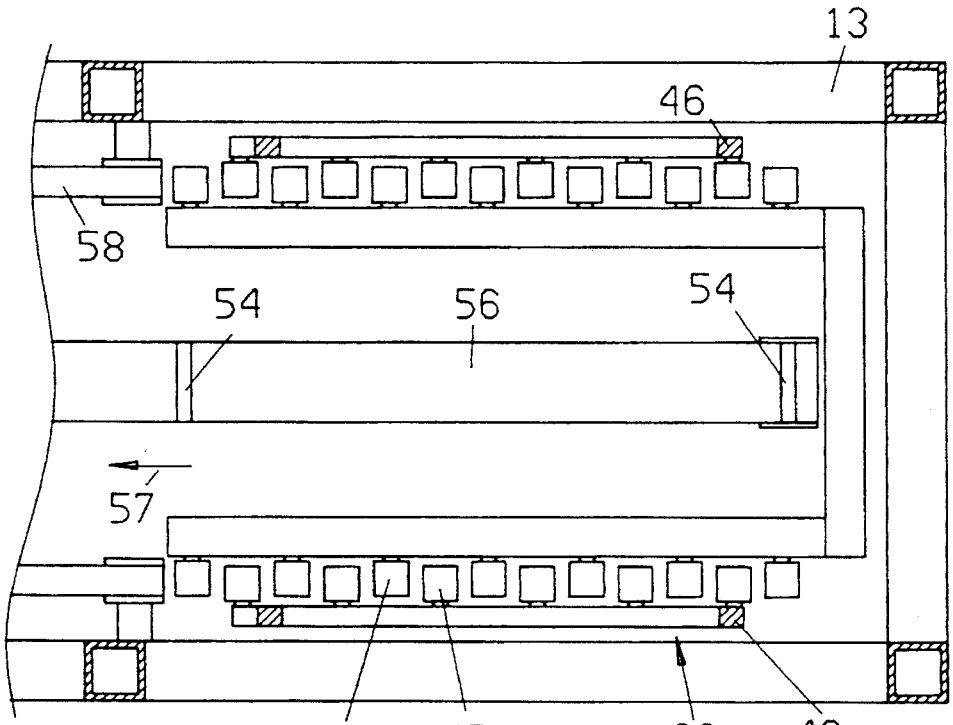
FIG. 6 is an enlarged plan view of the lowering means with the grippers and a portion of the frame shown in a horizontal sectional view.

The conveyor 38 which is used to lower successive emptied containers 2 from the upper level 14 to the lower level 16 (i.e., from the station 4 to the station 6) includes a cage movable up and down along an upright carrier 39 by a reversible electric motor 41 or another suitable prime mover. The details of a presently preferred lowering conveyor 38 are shown in FIGS. 4, 5 and 6. The cage of the illustrated conveyor 38 comprises two grippers 46 each of which carries a row of rotary supports in the form of rollers 47. A holder which is movable up and down along the carrier 39 supports two continuous or composite horizontal pintles 42, 43 each of which pivotably mounts the upper portion of the respective gripper 46. The means for pivoting the carriers 46 about the axes of the respective pintles 42, 43 includes fluid-operated motors 44 (e.g., pneumatic cylinder and piston units) which can move the respective carriers between the positions of FIG. 4 and the positions of FIG. 5. In FIG. 4, the rollers 47 of the carriers 46 support a container 2 from below. On the other hand, FIG. 5 shows the carriers 46 in the positions they assume when the rollers 47 are moved sideways and away from the container 2 at the lower level 16. At such time, the thus released lowered container 2 comes to rest on second sets of rotary supports 48 in the form of rows of aligned rollers or wheels at the station 6. The rollers 47 of the carriers 46 are staggered relative to the rollers 48 at the lower level 16 as seen in the direction of arrows 57 in FIGS. 2 and 3, namely in the direction of movement of containers 2 (with filled trays 1*b* therein) from the station 6 toward the lifting conveyor 12.

Figure 2:
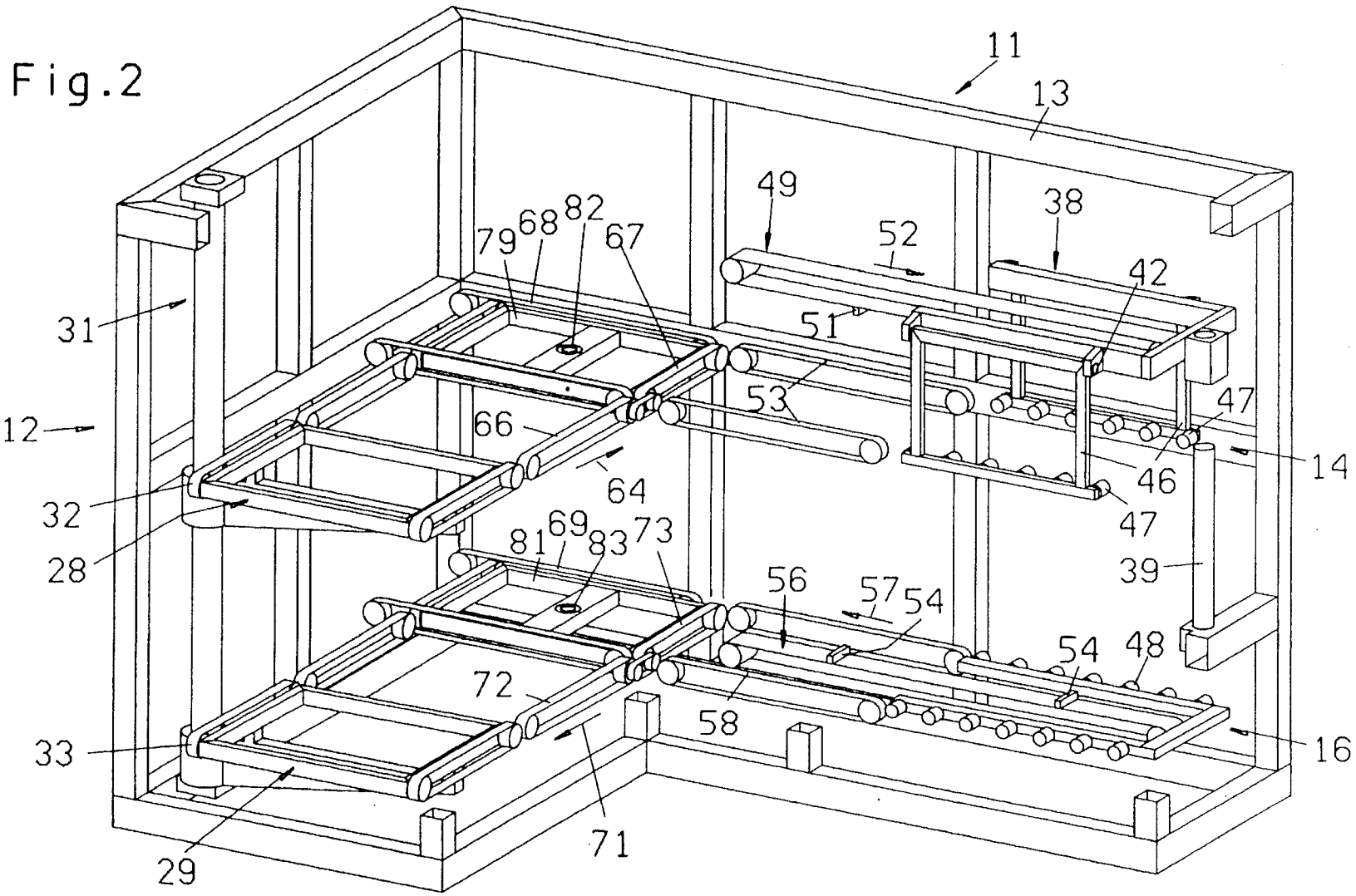
FIG. 2 is a perspective view of the apparatus of FIG. 1, with the containers removed and with the tray filling station omitted.
Figure 3:
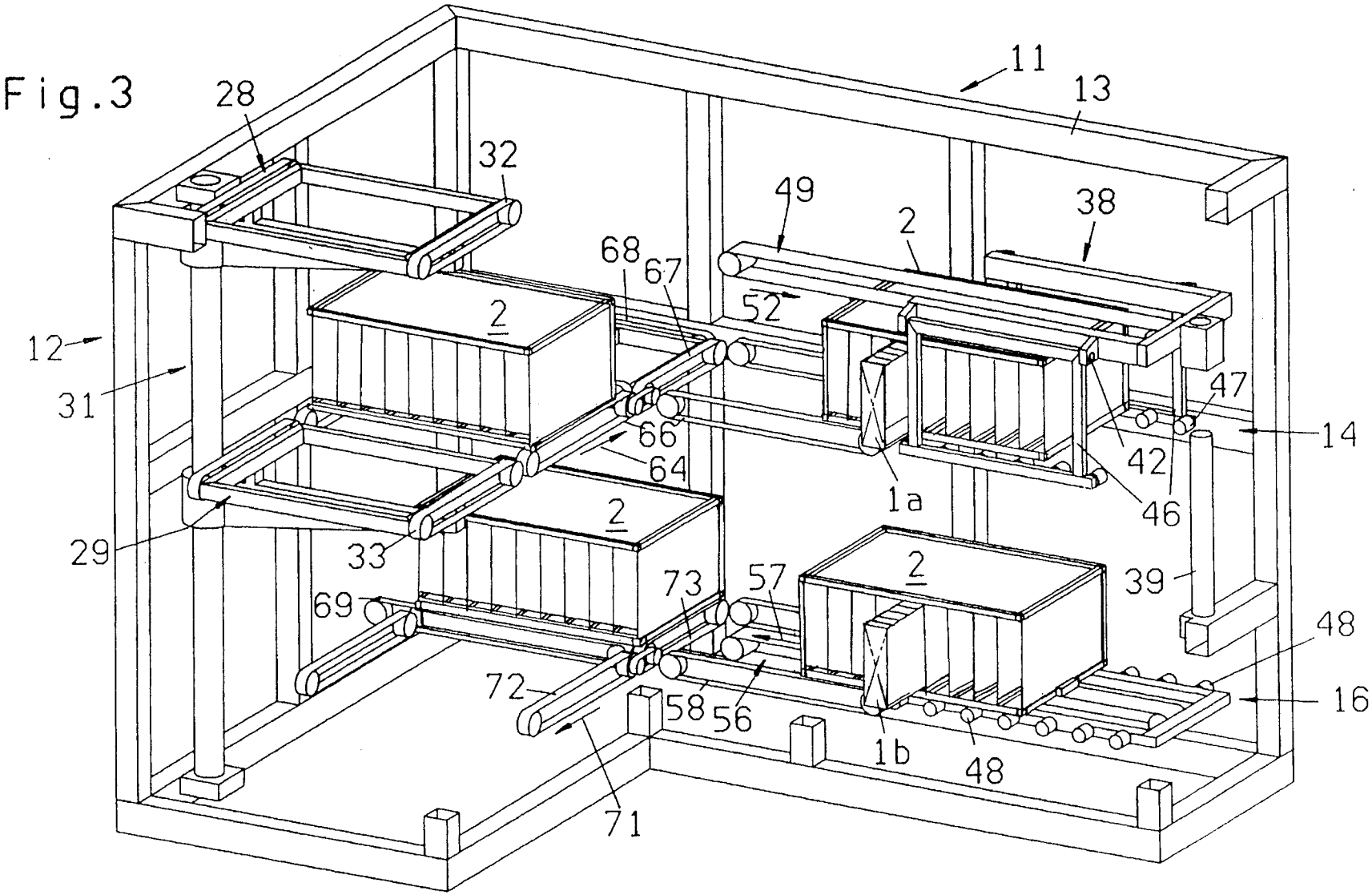
FIG. 3 illustrates the structure of FIG. 2 but with four filled and partially filled containers shown in different portions of their path.

The means for transporting containers 2 with empty trays 1*a* therein to the station 4 and into the cage of the lowering conveyor 38 comprises the belt conveyors 66 which register with the conveyors 32 or 33 depending upon whether the lifting conveyor 12 is maintained in the raised position of FIG. 3 or in the lowered position of FIG. 2. Such transporting means further comprises belt conveyors 67 which serve to receive successive containers from the conveyor 66 and to advance such containers in the direction of arrows 64, namely to a level above a pair of belt conveyors 68 which can be driven to advance containers 2 in the direction indicated by the arrows 52. The conveyors 68 are mounted on a frame 79 which can be moved up and down by an elevator drive 82. This renders it possible to lower the frame 79 and the conveyors 68 thereon to a level below the belt conveyors 67 so that the conveyors 67 can receive a container 2 with empty trays 1*a* from the conveyors 66. The frame 79 is thereupon raised by the elevator drive 82 to lift the container 2 above and off the conveyors 67, and the conveyors 68 are then set in motion to advance the container 2 thereon in the direction of arrows 52 and into the range of an intermittently operated endless belt conveyor 49 serving to move successive containers 2 past the station 4 and into the cage of the lowering conveyor 38 which, at such time, is located at the upper level 14.

The means for intermittently advancing a container 2 with the conveyor 49 in the direction of the arrows 52 includes one or more entraining elements or pushers 51 in the form of transversely extending strips at the outer side of the endless belt of the conveyor 49. The conveyor 49 is installed in the frame 13 at a level above two endless belt conveyors 53 which support successive containers 2 from below during transport from the conveyors 68 into the cage of the lowering conveyor 38. The drive means for the conveyors 53 is designed to positively move the upper reaches of these conveyors in the direction of arrows 52 or to permit the upper reaches to share the intermittent movements of the conveyor 49. At such time, the illustrated pusher 51 of the conveyor 49 engages the rear end of the top wall of a container 2 and moves the container stepwise into the lowering conveyor 38 at the station 4.

The means for conveying empty, partially filled and filled containers 2 at the lower level 16 in the direction indicated by arrows 57 includes an endless belt conveyor 56 which can be driven in stepwise fashion, the same as the aforedescribed conveyor 49 at the upper level 14, and is provided with one or more entraining elements or pushers 54 designed to engage the lower end portion of the rear sidewall of the container 2 at the station 6. The arrows 52 and 57 indicate that, when the conveyor 49 is driven in stepwise fashion, its lower reach advances in a direction to the right, as viewed in FIG. 2 or 3, whereas the upper reach of the conveyor 56 moves in a direction to the left (again as seen in FIG. 2 or 3) when it is called upon to advance a container 2 along the station 6 in stepwise fashion. An empty tray 1*a* is extracted from the adjacent container 2 between each of a series of intermittent movements of such container along the station 4, and a filled tray 1*b* is introduced into a container 2 during each of a series of successive stepwise movements of such container at the station 6. As already described hereinbefore, the means for removing empty trays 1*a* from a container 2 at the station 4 includes or can include one or more suction cups 24, and the means for introducing filled trays 1*b* into a container 2 at the station 6 during intervals between successive stepwise advances of such container with the conveyor 56 includes or can include one or more suction cups 26.

A container 2 which has received a set of filled trays 1*b* is advanced (by the pusher or pushers 54 of the conveyor 56) onto a pair of belt conveyors 58 which can be driven to advance the freshly filled container 2 in the direction of arrows 57 and away from the station 6, namely onto the upper reaches of two spaced-apart parallel belt conveyors 69 beneath the conveyors 68.

The means for intermittently driving the belt conveyor 49 comprises an electric stepping motor 59 or another suitable prime mover, and the means for intermittently driving the conveyor 56 includes an analogous or identical prime mover 61. The belt conveyors 53 can be driven by an electric motor or another suitable prime mover 62, and the conveyors 58 can be driven by an analogous or identical prime mover 63 (see FIG. 1).

The means for conveying containers 2 at the lower level 16 further comprises two spaced apart parallel belt conveyors 73 mounted on a frame 81 which can be moved up and down by an elevator drive 83. The frame 81 is lowered when the conveyors 69 are in the process of advancing a filled containers 2 in the direction of arrow 57 to a location beneath the conveyors 67, 68, and the drive 83 raises the frame 81 when the transfer of a container 2 from the conveyors 58 onto the conveyors 69 is completed. Such raising of the frame 81 enables the belt conveyors 73 to lift the container 2 off the upper reaches of the conveyors 69, and the conveyors 73 are thereupon set in motion to advance the container in the direction of arrows 71, i.e., onto the upper reaches of conveyors 72 which, in turn, can advance the container onto the belt conveyors 33 of the lifting conveyor 12 (at such time, the platform 29 of the conveyor 12 is located at the lower level 16).

The conveyors 68 can be driven by an electric motor 74 or an analogous prime mover, and the conveyors 69 can be driven by an analogous or identical prime mover 76 (shown in FIG. 1). The belt conveyors 66, 67 can be driven in unison by an electric motor or another suitable prime mover 77, and the belt conveyors 72, 73 can be driven in unison by an analogous or identical prime mover 78 (see FIG. 1).

The distances which are covered by the frames 79, 81 for the pairs of belt conveyors 67 and 73 can be small or very small, as long as they suffice to lower the upper reaches of the conveyors 67, 73 below the upper reaches of the conveyors 68, 69 (this permits unimpeded advancement of a container 2 at the level 14 from the conveyors 68 onto the conveyors 53 or unimpeded advancement of a container from the conveyors 58 onto the conveyors 69). When the frames 79, 81 are lifted by their respective drives 82 and 83, a container 2 is lifted off the belt conveyors 68 and can be advanced (by the conveyors 67) onto the conveyors 66, and a container 2 is lifted off the belt conveyors 69 so that the belt conveyors 73 can advance the thus lifted container onto the belt conveyors 72.

The operation of the improved container manipulating apparatus is as follows:

As can be seen in FIG. 3, the apparatus contains or can contain four discrete containers 2 when it is in actual use. At least a number of the several conveyors or pairs of conveyors at the upper level 14 can be set in motion, moved (stepwise or continuously) and brought to a halt independently of each other. The same holds true for the numerous continuously or intermittently driven conveyors or pairs of conveyors at the lower level 16. For example, the stepwise or intermittent movements of a container 2 confining empty frames 1*a* and being advanced by the conveyor 49 need not coincide with stepwise or intermittent movements of a container which is being moved by the conveyor 56 to receive a set of filled trays 1*b*. This also applies (or can hold true) for all of the conveyors which operate at the upper level 14 to advance a succession of containers 2 confining empty trays la from the conveyor system 27 to the conveyor 49, and for all of the conveyors which operate at the lower level 16 and serve to advance containers 2 confining filled trays 1*b* from the conveyor 56 to the conveyor system 27.

For the sake of simplicity and to facilitate the understanding of the method of the present invention, it is now assumed that the four containers 2 which are actually shown in FIG. 3 constitute four different positions of a single container.

FIG. 3 shows the plaforms 28, 29 of the lifting conveyor 12 in raised positions, i.e., the lower platform 29 is located at the upper level 14 and the belt conveyors 32 (which share the movements of the platform 28 along the upright carrier 31) have completed the transfer of a container 2 with a set of empty trays 1*a* from the platform 28 onto the belt conveyors 66. Such transfer of a container 2 from the platform 28 onto the conveyors 66 was preceded by the transfer of a freshly filled container 2 (confining filled trays 1*b*) from the level 16 to the level 14 (with the lower platform 29) and the transfer of such container onto the conveyor system 27 in response to advancement of the upper reaches of the belt conveyors 33 on the platform 29 in the direction indicated by arrows 71.

The conveyor 12 is thereupon actuated to move the platforms 28 and 29 to the levels 14 and 16 (see FIG. 2), i.e., to lower the belt conveyors 32 to the level of the conveyors 66 and to lower the belt conveyors 33 to the level of the belt conveyors 72.

The container 2 (with a set of empty trays 1*a* therein) is thereupon advanced by the belt conveyors 66 in the direction of the arrow 64 and onto the conveyors 67 which, at such time, are maintained in their raised positions (by the frame 79 and elevator drive 82) so that the container can move to a level above the belt conveyors 68. The frame 79 is thereupon lowered by its drive 82 so that the conveyors 67 descend with the frame 79 and the container 2 comes to rest on the conveyors 68. The motor for the conveyors 68 is started to advance the container 2 in the direction of the arrows 52, i.e., onto the conveyors 53 and into the range of the pusher 51 of the belt conveyor 49. The drive for the conveyors 53 is arrested as soon as the pusher 51 reaches and engages the upper end portion of the rear upright sidewall of the container 2, and the conveyors 53 thereupon merely serve to support the container 2 from below and their upper reaches are moved in the direction of arrows 52 at the speed and at the intervals determined by the pusher 51. The container 2 at the station 4 is relieved of successive empty trays 1*a* therein by the suction cup(s) 24 during intervals between successive stepwise advances of the conveyor 49. The evacuation of the last empty tray 1*a* is completed not later than or not appreciably later than when the thus emptied container 2 is fully received in the cage (grippers 46) of the lowering conveyor 38. The empty trays 1*a* which were withdrawn from the container 2 at the portion 17 of the upper level 14 enter the range of the tray filling apparatus 3 and receive piles of parallel cigarettes in a manner not forming part of the present invention.

When the container 2 at the station 4 is empty, it is supported only by the two rows of rollers 47 on the respective grippers 46. The conveyor 38 is or can be set in motion as soon as the container 2 in its cage has been advanced beyond the conveyors 53, and this results in a lowering of the container from the level 14 to the portion 18 of the level 16, i.e., to a position adjacent the station 6. The descending container 2 moves between two suitably spaced apart pushers 54 (see particularly FIG. 2) on the upper reach of the belt conveyor 56 and is ready to advance in the direction of arrows 57. Such stepwise movement of the container 2 at the station 6 is preceded by opening of the cage including the grippers 46 of the lowering conveyor 38 (compare FIGS. 4 and 5) so that the conveyor 38 is free to move back to the raised position at the level 14, to close its cage (i.e., to move the grippers 46 from the angular positions shown in FIG. 5 to those shown in FIG. 4) and to be ready for reception of a next-following container 2 (with a set of empty trays 1*a* therein) which is being advanced by the pusher 51 of the conveyor 49.

The cage of the lowering conveyor 38 can cause the empty container 2 therein to descend all the way onto the two rows of supports or rollers 48 at the station 6 because the rollers 47 on the grippers 46 of the conveyor 38 are staggered relative to the rollers 48 in the direction of the arrows 57, i.e., in the direction of stepwise advancement of the pushers 54 of the conveyor 56 toward the conveyors 69.

The conveyor 56 is thereupon set in motion to advance the initially empty container along the rollers 48 and onto the upper reaches of the conveyors 58. The suction cup or cups 26 introduce discrete filled trays 1*b* into the container 2 at the station 6 during each interval between successive stepwise or incremental advancements of the conveyor 56 in the direction of arrows 57 until the container is filled (i.e., such container then confines a full set of filled trays 1*b*). The container is or can be provided with internal partitions which divide its interior into discrete compartments, one for each tray of a full set of trays. Reference may be had to the aforementioned copending patent application Ser. No. 08/382,919 of Matthias Horn et al. for "Mobile receptacles for cigarette trays".

When a container 2 is being filled at the station 6, the upper reaches of the belt conveyors 58 are caused to advance in the direction of arrows 57 only as a result of frictional engagement with the bottom part of the intermittently moving container. However, the drive for the belt conveyors 58 is started when the filling of the container 2 with filled trays 1*b* is completed, and this results in advancement of the freshly filled container onto the belt conveyors 69. The next step involves lifting of the filled container off the belt conveyors 69 as a result of lifting of the frame 81 and belt conveyors 73 by the elevator drive 83 so that the container is lifted above and away from the upper reaches of the conveyors 69. The drive means for the conveyors 73 is started to transfer the container onto the belt conveyors 72, i.e., in the direction indicated by the arrows 71, and the conveyors 72 advance the container onto the belt conveyors 33. The platform 29 is thereupon lifted to the level 14 and the conveyors 33 on the platforms 29 are set in motion to transfer the filled container 2 into the conveyor system 27 for delivery into the tray evacuating apparatus or into storage.

An important advantage of the improved container manipulating apparatus is its compactness. Thus, the apparatus can support and intermittently advance a substantial number of filled, empty and refilled containers at the two levels 14 and 16 in such a way that a container which confines empty trays 1*a* is available at the upper station 4 and an empty container is available at the lower station 6 at intervals which are required to ensure that the containers which are being transported from the station 6 back to the conveyor system 27 can invariably receive and deliver to the tray emptying apparatus and/or into storage all of the cigarettes which are to be removed from the tray filling station. The difference between the levels 14 and 16 need not appreciably exceed the height of a container 2 and the conveyor 38 can move vertically downwardly in order to lower a freshly emptied container from the level 14 to the level 16, i.e., from the station 4 to the station 6. This, too, contributes to compactness of the improved apparatus without affecting its capacity. The compactness of the improved apparatus is also attributable to the fact that the containers 2 at the upper level 14 advance in a first direction (as indicated by the arrows 52) and that the containers 2 at the lower level 16 are caused to advance in a second direction (arrows 57) counter to the first direction.

Another important advantage of such positioning of the conveyors 49 and 56 that a freshly emptied container 2 can immediately descend vertically downwardly into the range of the conveyor 56 is that it is not necessary to provide discrete means for accurately positioning a freshly emptied container in the cage of the lowering conveyor 38 and/or discrete means for accurately positioning the descended or lowered empty container relative to the pushers or entraining elements 54 of the conveyor 56. In other words, the rightmost position of a freshly emptied container 2 at the station 4 is in exact vertical alignment with the rightmost or starting position of a freshly lowered container at the station 6.

The lifting conveyor 12 can be said to form part of the improved apparatus or a constituent of the conveyor system 27. An advantage of such lifting conveyor is that it can deliver containers 2 with empty trays 1*a* therein to the upper level 14 and that it can deliver containers 2 with filled trays 1*b* therein to the level 14 so that the containers with filled trays therein can be immediately advanced to the upper level of the tray evacuating apparatus.

The pairs of belt conveyors 66 and 72 constitute optional but desirable component parts of the improved apparatus. Such belt conveyors render it possible to remove containers with empty trays from the platform 28 or 29 as soon as the containers reach the conveyors 66, and that containers with filled trays 1*b* therein can be removed from the belt conveyors 72 (i.e., transferred onto the belt conveyors 33 on or of the platform 29) as soon as the platform 29 descends to the lower level 16.

The suction cups 24, 26 constitute but one form of the means which can be employed to remove empty trays 1*a* from and to introduce filled trays 1*b* into the respective containers. For example, the sidewalls 1A, 1B of each tray could be provided with handles, knobs, eyelets or other suitable devices which can be engaged by mechanically or pneumatically or hydraulically operated means for shifting the respective trays into or from the respective containers. An advantage of the suction cups 24, 26 is that they can properly engage and transmit motion to trays 1*a* or 1*b* having sidewalls 1A, 1B with smooth external surfaces. Thus, the improved apparatus can be used to manipulate containers for very simple and inexpensive trays.

The improved apparatus can be automated to any desired extent. For example, the positions of the containers 2, trays 1*a* and 1*b*, platforms 28, 29, frames 79, 81, lowering conveyor 38 and its grippers 46, suction cups 24, 26 and/or other mobile parts can be monitored by available detectors which transmit signals to a suitable control unit or regulating unit not forming part of the present invention. Such control unit also receives signals from the tray filling apparatus 3 and from the tray emptying apparatus which receives filled trays 1*b* from and supplies empty trays 1*a* to the conveyor system 27. Full automation of the afore-enumerated parts of the improved apparatus as well as of some or all other conveyors renders it possible to ensure highly reliable and efficient operation of the apparatus without necessitating any attention from the attendant or attendants.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A method of manipulating successive empty and filled containers for temporary confinement of sets of trays which are utilized for temporary storage of rod-shaped articles of the tobacco processing industry and are being advanced between an upper level and a lower level subsequent to termination of and prior to confinement in the containers, comprising the steps of transporting successive filled containers at said upper level; removing trays from successive containers at said upper level and moving the thus withdrawn trays downwardly to said lower level; lowering successive emptied containers from said upper level to said lower level; and introducing trays into successive emptied containers at said lower level.

2. The method of claim 1, wherein said transporting step includes moving successive filled containers in stepwise fashion to a predetermined position at said upper level and said removing step includes evacuating discrete trays between successive stepwise movements of the respective containers at said upper level, said lowering step including effecting a downward movement of successive emptied containers from said predetermined positions at said upper level to said lower level.

3. The method of claim 1, further comprising the step of transporting successive emptied containers at said lower level in stepwise fashion upon completion of the respective lowering step, said introducing step including inserting discrete trays into successive emptied containers between successive stepwise transports of emptied containers at said lower level.

4. The method of claim 1, wherein said removing step includes seriatim evacuating discrete trays from the respective containers at a first predetermined location at said upper level and said introducing step includes seriatim inserting discrete trays into the respective emptied containers at a second predetermined location disposed at said lower level and in at least substantial vertical alignment with said first predetermined position.

5. The method of claim 1, wherein said transporting step includes moving successive filled containers to a first predetermined position at said upper level and said lowering step includes effecting a downward movement of successive emptied containers from said first predetermined position at said upper level to a second predetermined position disposed at said lower level and being in at least substantial vertical alignment with said first predetermined position.

6. The method of claim 1, wherein at least one of said removing and introducing steps includes pneumatically moving trays relative to the respective containers.

7. The method of claim 6 of manipulating containers for trays having first and second relatively narrow and substantially upright sidewalls, wherein said removing step includes attracting the first sidewalls of the trays by suction and said introducing step includes attracting the second sidewalls of the trays by suction.

8. The method of claim 1, wherein said transporting step includes moving successive filled containers at said upper level in a first direction and thereupon in a second direction other than said first direction.

9. The method of claim 1, further comprising the steps of conveying successive refilled containers at said lower level and thereupon lifting the refilled containers to said upper level.

10. Apparatus for manipulating successive empty and filled containers for temporary confinement of sets of trays which are utilized for temporary storage of rod-shaped articles of the tobacco processing industry, comprising means for transporting filled containers at a first level to an emptying station; means for conveying filled containers at a lower second level from a filling station; and means for lowering successive emptied containers from said emptying station to said filling station, said transporting means including means for moving successive filled containers at said emptying station and onto said lowering means in a first direction and said conveying means including means for moving successive emptied containers in stepwise fashion at said filling station in a second direction at least substantially counter to said first direction.

11. The apparatus of claim 10, wherein said moving means of said transporting means includes means for moving successive filled containers in stepwise fashion at said emptying station and onto said lowering means.

12. The apparatus of claim 10, wherein said lowering means comprises a plurality of grippers including rotary supports and means for moving at least one of said grippers relative to each other gripper to thereby move said supports beneath a container at said emptying station and to move said supports away from the lowered container at the filling station.

13. The apparatus of claim 12, wherein said rotary supports include rows of rollers.

14. The apparatus of claim 12, wherein said conveying means includes means for moving containers along and away from said filling station in said second direction and additional rotary supports for successive lowered containers at said filling station, said additional supports being staggered in said second direction with reference to the supports of said grippers.

15. The apparatus of claim 10, further comprising means for removing sets of trays from successive containers at said emptying station and means for introducing sets of trays into successive emptied containers at said filling station, at least one of said removing and introducing means including pneumatic means for moving trays at the respective station.

16. The apparatus of claim 15, wherein said pneumatic means includes means for attracting trays by suction.

17. The apparatus of claim 10, further comprising means for lifting containers from said lower level to said first level.

18. The apparatus of claim 17, wherein said lifting means includes at least one platform arranged to receive successive filled containers from said conveying means and to move the thus received containers from said lower level to said first level.

* * * * *